United States Patent [19]

Hawkins

[11] Patent Number: 4,832,274

[45] **Date of Patent: * May 23, 1989**

[54] FILM WINDING APPARATUS AND METHOD

[75] Inventor: William E. Hawkins, Circleville, Ohio

[73] Assignee: E. I. Du Pont de Nemours and Company, Wilmington, Del.

[ * ] Notice: The portion of the term of this patent subsequent to May 16, 2006 has been disclaimed.

[21] Appl. No.: 22,103

[22] Filed: Mar. 5, 1987

Related U.S. Application Data

[63] Continuation-in-part of Ser. No. 483,368, Apr. 8, 1983.

[51] Int. Cl.[4] ..... B65H 18/16

[52] U.S. Cl. ..... 242/65

[58] Field of Search ..... 242/65, 66, 67.1 R, 242/75.1, 75.2, 76, 56.4; 226/196, 199; 26/101, 102, 103, 104; 139/304, 305; 162/271; 66/149 R, 152, 153

[56] References Cited

U.S. PATENT DOCUMENTS

| | | | |
|---|---|---|---|
| 1,026,482 | 5/1912 | White | 242/66 |
| 2,486,121 | 10/1949 | Corn | 226/199 X |
| 3,106,365 | 10/1963 | Karr | 242/76 |
| 3,222,004 | 12/1965 | Crowe | 242/56.9 |
| 3,279,718 | 10/1966 | Arterton et al. | 242/67.1 R |
| 3,298,624 | 1/1967 | Schott | 242/67.1 R |
| 3,305,153 | 2/1967 | Keding et al. | 226/199 X |
| 3,410,499 | 11/1968 | Schmidt | 242/67.1 R |
| 3,433,429 | 3/1969 | Schnitzspahn | 242/65 |
| 3,438,100 | 4/1969 | Moore | 26/63 |
| 3,719,316 | 3/1973 | Frye | 226/199 |
| 3,756,527 | 9/1973 | Collins et al. | 242/56.2 |
| 3,854,646 | 12/1974 | Dorfel | 226/191 |
| 4,193,559 | 3/1980 | Ballard | 242/67.1 R |
| 4,343,440 | 8/1982 | Engl | 242/67.1 R |
| 4,374,575 | 2/1983 | Lerch et al. | 242/56.5 |
| 4,410,122 | 10/1983 | Frye et al. | 226/199 |

FOREIGN PATENT DOCUMENTS

| | | |
|---|---|---|
| 639527 | 3/1928 | France . |
| 1179865 | 12/1958 | France . |
| 2210240 | 7/1974 | France . |
| 42-17781 | 9/1967 | Japan . |
| 54-48192 | 3/1979 | Japan . |
| 54-812 | 4/1979 | Japan . |
| 155747 | 11/1980 | Japan . |
| 57-28658 | 6/1982 | Japan . |
| 1091967 | 11/1967 | United Kingdom . |
| 2103188 | 2/1983 | United Kingdom . |

*Primary Examiner*—John M. Jillions

[57] ABSTRACT

An apparatus and method for winding thin films. Boundary air is discharged and the layers are compressed by a flexible, bowed idler roller located between a winding roll and a backup drive roll. High quality rolls free from wrinkles are produced.

18 Claims, 5 Drawing Sheets

FILM WINDING APPARATUS AND METHOD

CROSS-REFERENCE TO RELATED APPLICATION

This application is a continuation-in-part of application Ser. No. 483,368, filed Apr. 8, 1983.

BACKGROUND

This invention relates generally to the manufacture of thin film and, more particularly, to the winding of such film into rolls of high quality.

Equipment for winding rolls from a continuous length of film is available and in use. It is known that bowed rolls and/or spreader bars can be used in advance of the windup to flatten the film. Although such devices spread the film in transport, additional defects are introduced in the actual winding process. For example, as film is advanced to a roll, boundary air is entrapped and compressed slightly between the outside film layers and moves to regions between high spots or gage bands. This compressed air increases the diameter of the roll slightly where the film layers are thinnest. Resulting bubble-like areas reduce the laydown width. When the air bleeds to atmosphere, the affected film layers fold into wrinkles in the machine direction (MD). It is difficult, if not impossible, to avoid prominent, unacceptable wrinkles when winding ultra-thin film according to standard methods. Such wrinkles have an adverse effect on yield insofar as they present difficulties in achieving uniformity in subsequent coating, metallizing and laminating steps.

SUMMARY

Film has been wound into rolls of high quality on an apparatus which includes a winding roll, a drive roll and a flexible, bowed idler roller between and in contact with the winding and drive rolls. The idler roller preferably is mounted between pivoted arms and means are provided for adjusting the arms to flex and thereby bow the roller. Alternatively the idler roller may be mounted for linear movement on a mount having means for adjusting the orientation of the bow.

DRAWINGS

In the appended drawings.

Figure 4A:
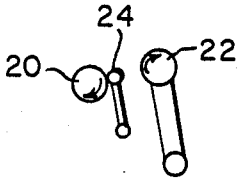
Figure 4B:
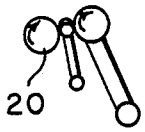
Figure 5:
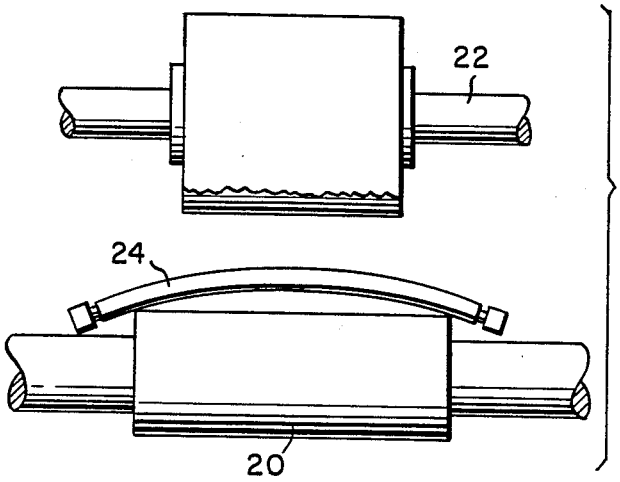
Figure 6:
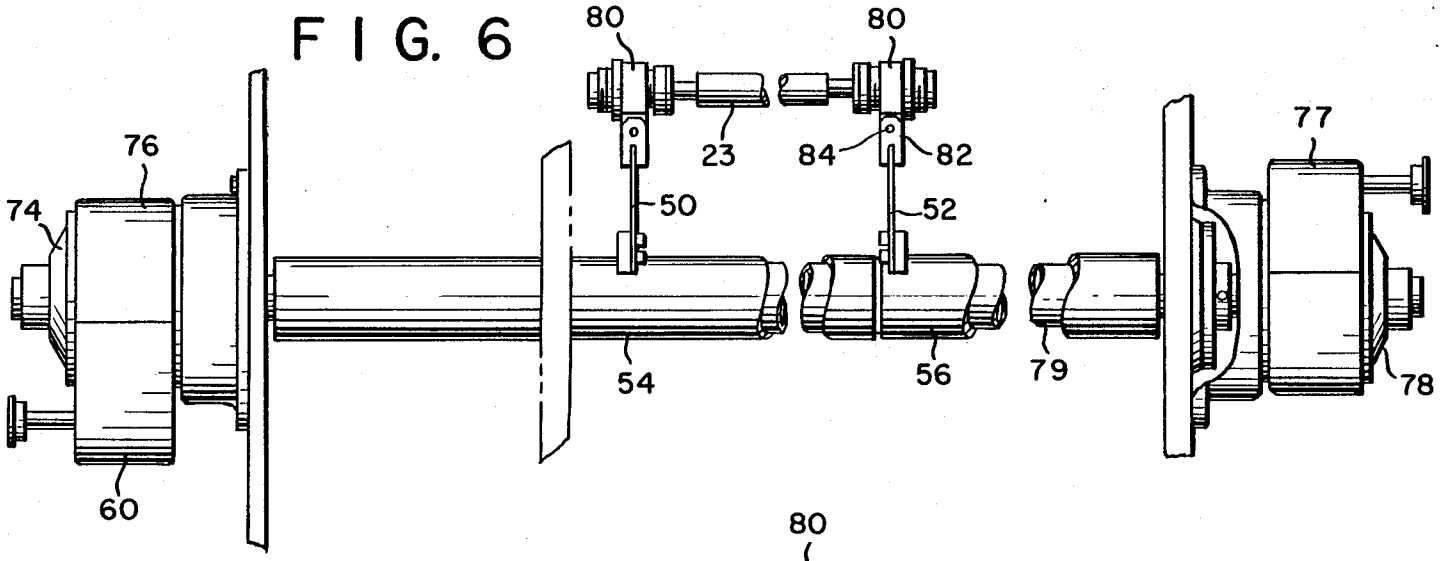
Figure 7:
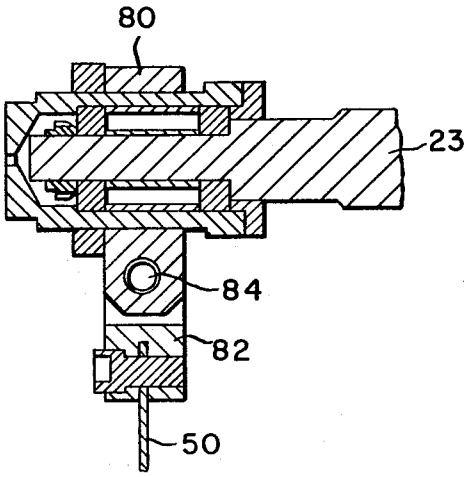
Figure 8A:
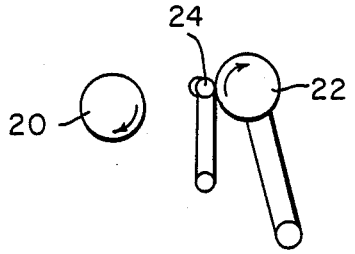
Figure 8B:
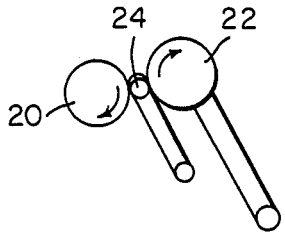
Figure 9A:
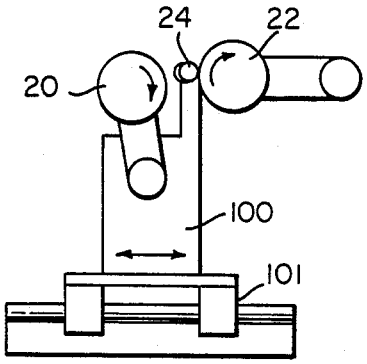
Figure 9B:
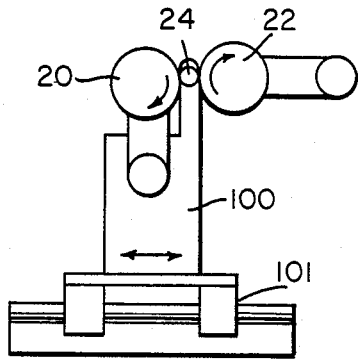
Figure 10A:
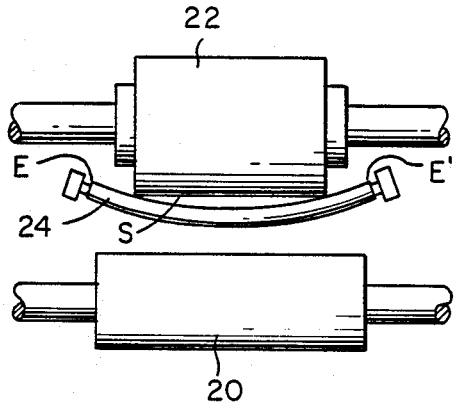
Figure 10B:
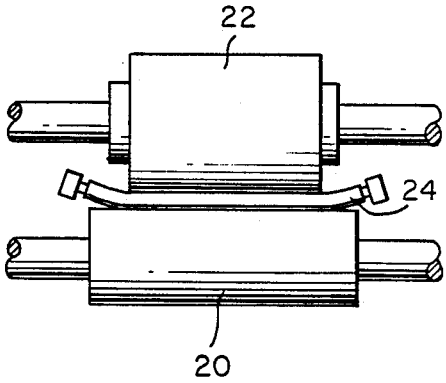

FIGS. 4A and 4B are schematic illustrations of the bow in the idler roller before and after it is engaged by a winding roll, FIG. 5 is a schematic illustration of the manner in which the idler roller is flexed and bowed against a drive roll, FIGS. 6 and 7 are detailed illustrations of the pivoted arms and other parts which support the idler roller in the operative positions shown in FIGS. 1–5, FIGS. 8A, 8B, 9A and 9B are schematic illustrations of modifications of the winding apparatus of this invention showing the bow in the idler roller before and after it is engaged by the drive roll, FIGS. 10A and 10B are schematic illustrations of the manner in which the idler roller is flexed and bowed against the winding roll, and showing the idler roller after it is engaged by the drive roll.

DESCRIPTION

Figure 1:
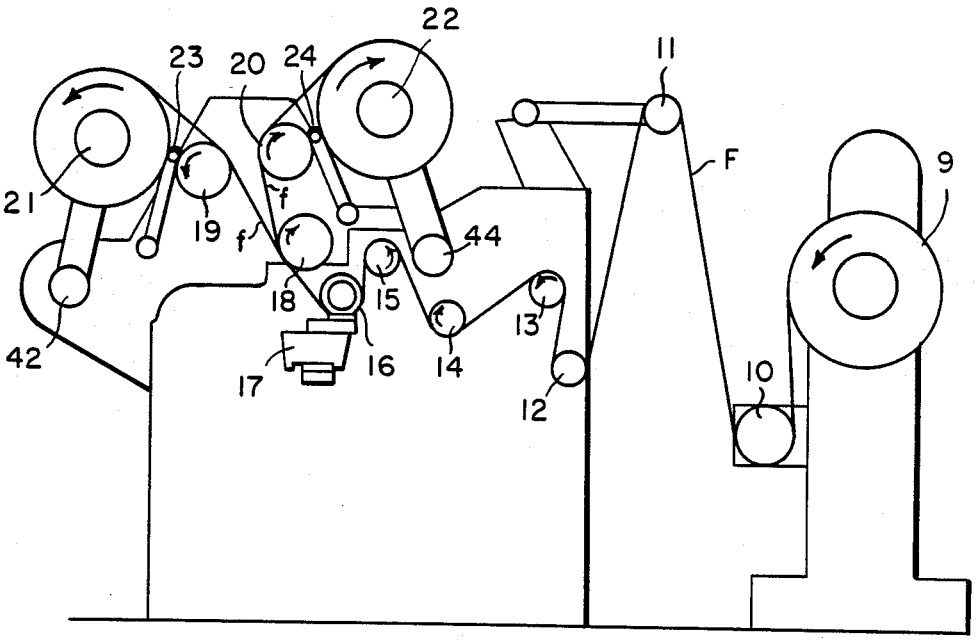
FIG. 1 is a schematic, side view of a winding apparatus into which the flexible, bowed idler roller of the present invention has been incorporated.

Referring to FIG. 1, the apparatus into which the improvements of the present invention have been incorporated includes a stand for a mill roll 9. Film F from roll 9 advances over freely rotatable rolls 10, 11, 12 and pull rolls 13, 14, 15 to knife roll 16 where it is slit by a bar knife 17. The slit film passes over pull roll 18. Slit halves f pass over backup drive rolls 19, 20 and advance tangentially to winding rolls 21, 22. Such a tangential approach provides a hydrostatic air cushion which supports each film f prior to laydown. After substantial wraps on the winding rolls, the cushioned films reach solid, flexible, bowed idler rolls 23, 24. In the illustrated embodiment, there are wraps of about 270° before film f reach idler rollers 23, 24 which have diameters substantially less than the diameters of the winding and drive rolls. Each idler roller is located between a drive roll and a winding roll and has its rotational axis offset from the axes of those rolls. As shown, the winding rolls and idler rollers are swingably mounted on arms. Each winding roll is biased against and is surface driven by its idler roller which, in turn, is driven by its drive roll. The manner in which the idler rollers are first bowed and then twisted in the direction of advance for the film is described below with reference to FIGS. 4–7. The concentrated, bowed roll point of the relatively small rollers 23, 24 at laydown is surprisingly effective in blocking and discharging boundary air. At the same time, they spread films f on rolls 21, 22.

Figure 2:
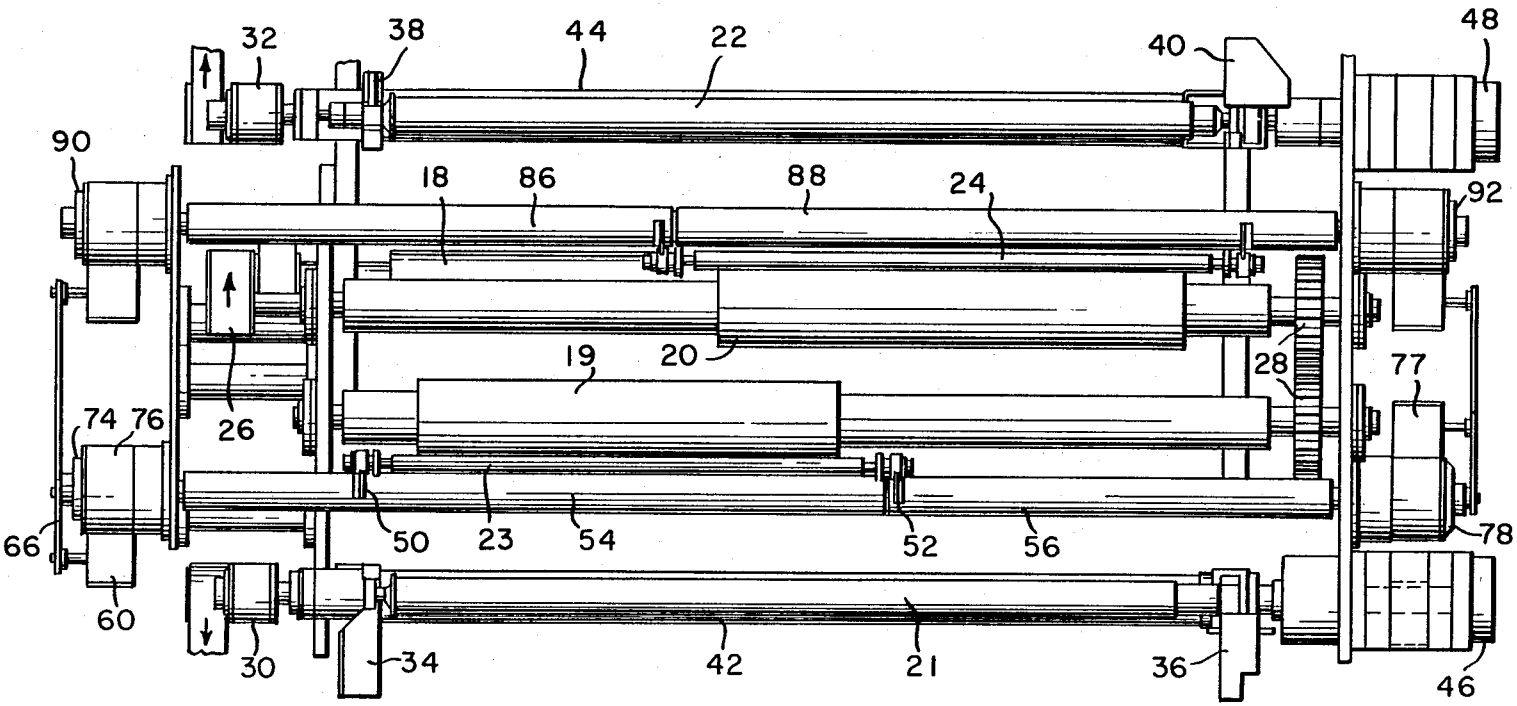
FIGS. 2 and 3 are top end views of the apparatus.
Figure 3:
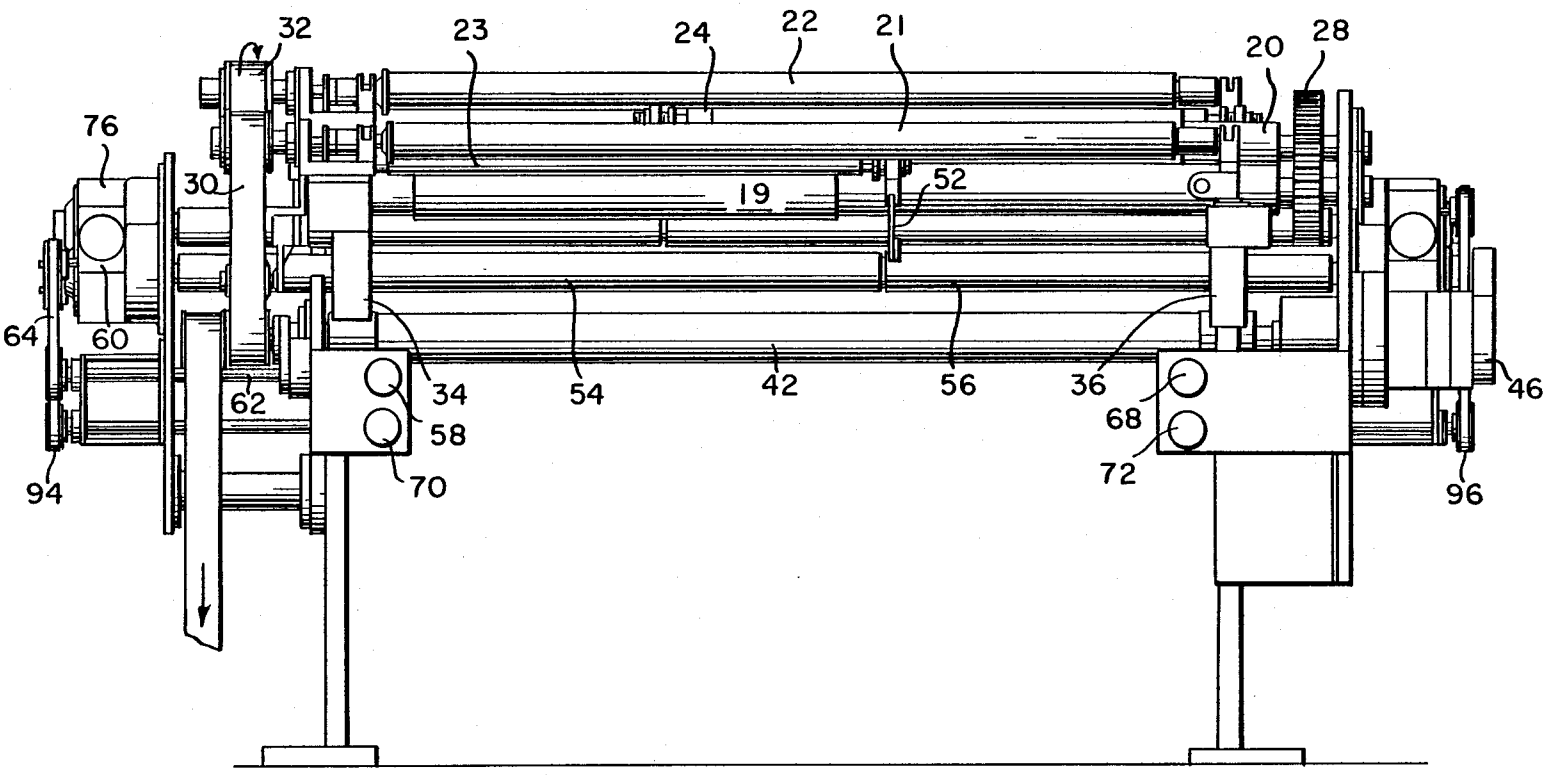

As shown in FIGS. 2 and 3, rear drive roll 20 is rotatably driven by a motor driven belt 26 and coupled with front drive roll 19 by spur gears 28. In addition, motor driven belts 30, 32 are coupled to winding rolls 21, 22. Both the winding and the drive rolls are rotatably driven in order to establish and maintain a minimum level of web feed tension at the idler roller.

Winding roll 21 is rotatably mounted between arm assemblies 34, 36 and rear roll 22 between arm assemblies 38, 40. The arm assemblies are fixed to shafts 42, 44 and torque is applied to those shafts, for swinging rolls 21, 22 toward and away from idler rollers 23, 24, by hydraulic, vaned, rotary actuators 46, 48. The actuators furnish enough rotary power to maintain the desired levels of pressure on the idler rollers. Rolls 21, 22 can, of course, be removed from the arm assemblies for the donning of empty cores and the doffing of cores with rolls of film thereon.

Idler roller 23 is rotatably mounted between arms 50, 52 and the latter are attached to adjusting rolls 54, 56. Arm 50 and roll 54 can be rotated by hand wheel 58 which is coupled to a bracket 60 through a shaft 62 and a chain 64. Between the reaches of chain 64, there is a connecting link 66 (FIG. 2). Arm 52 and roll 56 can also be adjusted, through a link and chain drive, by a hand wheel 68 (FIG. 3). Similarly, the pivot arms for idler roller 24 and the split rolls to which they are attached can be adjusted by hand wheels 70, 72.

The manner in which the idler rollers are flexed, bowed and then twisted in the direction of advance is shown in FIGS. 4A, 4B and 5. Hand wheels 70, 72 are turned to bring idler roller 24 into engagement with the enlarged portion of drive roll 20 and then turned further to bow the offset roller 24 to the position shown in FIGS. 4A and 5. When winding roll 22 is biased against roller 24, by rotary actuator 48, the roller is twisted upwardly to the position shown in FIG. 4B, producing a compound bow which, in effect, spring loads the roller against the winding roll.

Referring now to FIGS. 6 and 7, it will be seen that adjusting roll 54 is coupled to bracket 60 through a gearbox 74. Bracket 60 is attached to a ring 76 which is rotatable on box 74. Similarly, adjusting roll 56 is coupled to a bracket 77 through a gear box 78. Adjusting rolls 54, 56 are relatively rotatable on a support tube 79. Details of the manner in which one end of roller 23 is mounted for rotation in a housing 80 and the housing is attached to the thin, flat arm 50 are shown in FIG. 7. There is an identical housing 80 coupling the other end of roller 23 to arm 52. Between each housing and the legs of a yoke 82, there is a pin 84. Flexing and bowing of idler roller 23 is facilitated by rotational movements about pins 84 and slight twisting movements of flat arms 50, 52. Idler roller 24 is flexed and bowed by adjustments of rolls 86, 88 (FIG. 2) through gear boxes 90, 92, chains 94, 96 and hand wheels 70, 72.

In addition to the manual adjustments of idler rollers 23, 24, the flexible bearing arrangements shown in FIGS. 6 and 7 permit the operating bow in each idler roller to change in response to eccentricities between the driving and winding rolls and/or in response to variations in thickness of the film. The thicker lanes at gage bands lead to slight twisting of an idler roller into adjoining areas where boundary air would still accumulate and form bubbles. Thus, boundary air is blocked and discharged at laydown. In addition, the high contact pressure at the narrow footprint of the idler roller forces areas of film in the thicker lanes into closer proximity than the thinner areas by compressing the interface regions occupied by surface asperities. These cumulative effects of the self-adjusting idler rollers disclosed herein have led to the production of high quality rolls free from wrinkles. Furthermore, the quality of the wrinkle free, slit rolls does not degrade with time.

The apparatus is readied for slitting and rewinding by threading film F from mill roll 9 around rolls 10–16 and raising the blade of bar knife 17 to start a slit. Then, enough film is advanced beyond roll 16 to present, after a transverse cut by the operator, separate films f of sufficient length to reach pretaped cores on winding rolls 21, 22. With the latter pressing against idler rollers 23, 24, rolls of films f are wound. The concentrated roll prints of the relatively small idler rollers 23, 24 on winding rolls 21, 22 block and discharge boundary air. Furthermore, the flexible resilience of those rollers and the flexibility of their pivotal mounts leaves them free to adjust automatically to variations in the surfaces of rolls as they are being wound.

In an operable embodiment, the idler roller was fabricated from a rod of a hardened steel alloy. The working surface was polished, had a diameter of 0.03 meter (m.), a working surface 0.96 m. in length and a bow span of 1.33 m. The enlarged portion of the driving roll was 0.81 m. in length and 0.159 m. in diameter. The ratio of operating diameters, driving roll to idler roller, was 5.3. The driving roll was fabricated from a hardened steel alloy and its working surface covered with a tough, abrasive resistant, elastomeric finish having a durometer hardness of 65–70. Rotary actuators 46, 48 were Rotac fluid power rotary actuators, Model No. RN-63-RV, Ex-Cell-O Corp., Greenville, Ohio.

FIGS. 4A, 4B and 5 show a preferred method of operation of the apparatus of this invention.

In this method, the flexible idler roller 24 is moved into a position so that it is bowed in a direction outwardly from the surface of the drive roll 20, as seen in FIG. 5. As thus positioned, when the idler roller 24 and the winding roll 22 are brought into engagement with each other, the bow in the roller 24 will be twisted in the direction of film movement and greater forces will be placed on the center portion of film being wound onto the winding roll 22 than at its edges.

More specifically, the flexible idler roller 24 is supported at each end, and to cause it to bow as described above, such roller 24 is first moved into initial contact with the surface of the drive roll 20 and then is moved further so that the ends of the roller 24 are positioned below the plane of the surface of the drive roll 20, as seen in FIG. 5, whereby the flexible roller 24 is bowed outwardly from the surface of such drive roll 20.

The idler roller 24 may be pivotally moved into engagement with the drive roll 20, see FIG. 4A, or the drive roll may be pivotally moved into engagement with it, as shown in FIG. 9B. Further the idler roller 24 and winding roll 22 may be moved into engagement with each other by either pivotal movement, see FIGS. 4B and 8A, or linear movement, see FIG. 9A.

FIGS. 8A through 10B show various modifications of this invention.

More specifically, FIGS. 8A and 8B and 10A and 10B illustrate, schematically, a second preferred method of operation of the apparatus shown in FIGS. 1–3 and 6 and 7.

In practicing this method, hand wheels 70, 72 are turned to move the flexible idler roller 24 first into contact with the surface S or enlarged portion of the winding roll 22 and then turned further to bow the roller into the position, as shown in FIG. 10A, in a direction facing outwardly from such winding roll. As thus positioned, as will be seen, greater forces are placed at the edges of the winding roll 22. Further these forces are controllable by the operator depending on the final positions of the ends E and E′ of the idler roller 24 below the plane of the surface S of such winding roll 22.

After this step has been completed, the drive roll 20 and idler roller 24 are moved into engagement with each other to twist the roller 24 in the direction of film travel and thereby spring load the roller 24 against the winding roll 22, as best seen in FIG 10B. By so doing the primary forces are brought to bear against the edges of film being wound on the winding roll 22 to help spread the film and provide for effective winding.

This method differs from the method previously described in connection with FIGS. 4A, 4B and 5 in which the idler roller 24 is moved against the drive roll 20 to bow the roller, after which it is moved into engagement with the winding roll 22 to spring load such idler roller 24 against the winding roll. By following this method greater forces are brought to bear on the center portion of the film, which for certain films and winding conditions is to be desired.

FIGS. 9A and 9B show a modified version of the apparatus of this invention. It is similar to the apparatus shown in FIGS. 1–3 and 6 and 7 except the flexible idler roller 24 is mounted on a linearly movable mount 100 which is coupled to means 101 for moving the flexible roller 24 into engagement with the winding roll 22 and into the position shown in FIG. 10A. A suitable device for accomplishing such linear movement of the flexible roller 24 is shown in U.S. patent application Ser. No.

559,375, filed Dec. 8, 1983, the teachings of which are incorporated by reference herein.

I claim:

1. A film-winding apparatus comprising a winding roll, a drive roll and a flexible, bowed idler roller between and in contact with said rolls through their lengths, said apparatus further including a linearly movable mount, said idler roller being mounted on said mount, and thereafter means coupled to said mount for moving said idler roller into engagement with said winding roll to flex and thereby bow said idler roller.

2. The apparatus of claim 1 wherein said drive roll is mounted for swinging movement toward and away from said idler roller and said apparatus further including means for biasing the drive roll toward the idler roller and thereby twisting the bow in said idler roller.

3. The apparatus of claim 2 wherein said idler roller has its axis offset from the axes of said winding and drive rolls.

4. The apparatus of claim 3 wherein said idler roller has a diameter substantially less than the diameters of said winding and drive rolls.

5. A film-winding apparatus including:

a winding roll, a drive roll, a flexible idler roller positioned between said winding and drive rolls, means for moving said idler roller and said drive roll into engagement with each other to flex and thereby bow the roller, and means for moving said idler roller and said winding roll into engagement with each other thereby twisting the bow in said idler roller.

6. The apparatus of claim 5 wherein said idler roller is pivotally moved into engagement with said drive roll and said winding roll is pivotally moved into engagement with said idler roller.

7. The apparatus of claim 5 wherein said drive roll is pivotally moved into engagement with said idler roller and said idler roller is linearly moved into engagement with said winding roll.

8. A film-winding apparatus including:

a winding roll, a drive roll, a flexible idler roller positioned between said winding and drive rolls, means for moving said idler roller and said winding roll into engagement with each other to flex and thereby bow the roller, and means for moving said idler roller and said drive roll into engagement with each other thereby twisting the bow in said idler roller.

9. The apparatus of claim 8 wherein said idler roller is pivotally moved into engagement with said drive roll and said winding roll is pivotally moved into engagement with said idler roller.

10. The apparatus of claim 8 wherein said drive roll is pivotally moved into engagement with said idler roller and said idler roller is linearly moved into engagement with said winding roll.

11. A method of winding film including the steps of:

moving a flexible idler roller and a drive roll into engagement with each other to flex and thereby bow said flexible idler roller, and moving said idler roller and a winding roll into engagement with each other thereby to twist the bow in said flexible idler roller.

12. The method of claim 11 wherein said flexible idler roller is supported at each end and is first moved into initial contact with the surface of said drive roll and then moved further so that the ends of said roller are positioned below the plane of the surface of said drive roll whereby said flexible idler roller is bowed in a direction outwardly from the surface of said drive roll and whereby when said idler roller and said winding roll are brought into engagement with each other the bow will be twisted in the direction of film travel and greater forces will be placed on the center portion of film being wound on said winding roll.

13. The method of claim 11 wherein said idler roller is pivotally moved into engagement with said drive roll.

14. The method of claim 11 wherein said idler roller is linearly moved into engagement with said drive roll.

15. A method of winding film including the steps of:

moving a flexible idler roller and a winding roll into engagement with each other to flex and thereby bow said flexible idler roller, and moving said idler roller and a drive roll into engagement with said other thereby to twist the bow in said flexible idler roller.

16. The method of claim 15 wherein said flexible idler roller is supported at each end and is first moved into initial contact with the surface of said winding roll and then moved further so that the ends of said roller are positioned below the plane of the surface of said winding roll whereby said flexible idler roller is bowed in a direction outwardly from the surface of said winding roll and whereby, when said idler roller and said drive roll are brought into engagement with each other, the bow will be twisted in the direction of film travel and greater forces will be placed on the edges of film being wound on said winding roll.

17. The method of claim 15 wherein said idler roller is pivotally moved into engagement with said winding roll.

18. The method of claim 15 wherein said idler roller is linearly moved into engagement with said winding roll.

* * * * *